US005877131A

United States Patent [19]

Barnes

[11] Patent Number: 5,877,131

[45] Date of Patent: Mar. 2, 1999

[54] TRANSLUCENT LUBRICANT

[75] Inventor: John F. Barnes, Arlington, Tex.

[73] Assignee: NCH Corporation, Irving, Tex.

[21] Appl. No.: 917,997

[22] Filed: Aug. 25, 1997

[51] Int. Cl.[6] ..... C10M 141/00; C10M 141/10; C10M 157/00

[52] U.S. Cl. ..... 508/312; 508/316; 508/318; 508/319; 508/320; 508/491

[58] Field of Search ..... 508/312, 316, 508/318, 319, 320, 491

[56] References Cited

U.S. PATENT DOCUMENTS

| | | | |
|---|---|---|---|
| 1,967,255 | 7/1934 | Penniman | 508/312 |
| 2,862,803 | 12/1958 | Oosterhout | 508/312 |
| 2,894,970 | 7/1959 | McKinley et al. | 508/312 |
| 3,095,375 | 6/1963 | Pitman | 508/312 |

OTHER PUBLICATIONS

Technical Information No. 7183–9 of Hercules Incorporated of Wilmington, DE regarding PICCOPALE 100, Aliphatic Hydrocarbon Resin with attached Material Safety Data Sheet (date unknown).

*Primary Examiner*—Jerry D. Johnson
*Attorney, Agent, or Firm*—Locke Purnell Rain Harrell, P.C.; Monty L. Ross

[57] ABSTRACT

A translucent wire and cable lubricant containing from about 30 to about 80 weight percent of a mixture further comprising a resin and an oil, from about 10 to about 40 weight percent solvent, from about 1 to about 15 weight percent thermoplastic synthetic polymer, from about 1 to about 15 weight percent oxidized wax, from about 1 to about 15 percent sheep tallow, an extreme pressure agent, an antiwear agent, and a corrosion inhibitor.

49 Claims, No Drawings

TRANSLUCENT LUBRICANT

BACKGROUND OF THE INVENTION

1. Field of the Invention

This invention relates to lubricants, and more particularly to a novel lubricant that forms a protective translucent coating and is especially useful for coating wire ropes, cables, and chains.

2. Description of Related Art

Because wire ropes and cables tend to wear from the inside to the outside during use, a useful lubricant must be capable of penetrating to the interior strands and then have sufficient adhesion and film toughness to remain in place throughout its normal service life. A useful lubricant for wire ropes and cables should also adhere to coated surfaces without being so tacky that it collects quantities of sand or grit that increase friction and wear.

Many of the effective cable lubricants currently in use are asphalt-based products. As such, they suffer from certain disadvantages. For example, asphalt-based cable lubricants are usually black and opaque, which means that cable inspection is difficult and costly due to the need to remove the protective coating and then to reapply the lubricant after inspection. Furthermore, asphalt compounds are no longer desirable for use in environmentally sensitive areas and are being phased out in Europe. Although some users of cable lubricants are experimenting with gear oils, these products have generally met with only limited success. Many gear oils simply do not have the necessary properties to serve as a protective and effective lubricant. Many flow out of the wire ropes and cables to which they have been applied a short time after application.

SUMMARY OF THE INVENTION

The lubricant disclosed herein is translucent, amber-orange in color, and is particularly useful for the lubrication and protection of wire ropes, cables, and chains. The product penetrates into the cables, links, and fibers to prevent wear and corrosion inside and out. All of this is accomplished by a unique blend of lubricants, tackifiers, film-forming agents, penetrating solvents, water displacers, extreme pressure agents, antiwear agents, and corrosion inhibitors.

The lubricant of the invention is also easy to use. The preferred compositions as disclosed herein are flowable at temperatures higher than about 20° F. to facilitate penetration. The translucence of the product allows for easy cable inspection without removal of the protective coating. After an extended period, the lubricant will darken, indicating that the time has come to reapply a fresh coating.

The translucent lubricants of the invention will preferably comprise an aliphatic and/or aromatic resin, naphthenic oil, aliphatic and/or aromatic solvents, a thermoplastic synthetic polymer, oxidized wax, an extreme pressure agent, an antiwear agent, and a corrosion inhibitor. Compositions of the invention will preferably comprise from about 40 to about 80 weight percent of an aliphatic or aromatic resin and naphthenic oil, from about 10 to about 40 weight percent of an aliphatic solvent and an aromatic solvent, a minor effective amount up to about 15 weight percent of thermoplastic synthetic polymer, a minor effective amount up to about 15 weight percent of an oxidized wax, a minor effective amount up to about 5 weight percent sheep tallow, and the remainder of an additive package comprising minor effective amounts of an extreme pressure additive, an antiwear additive and a corrosion inhibitor. Most preferably, the subject translucent lubricant will contain an aliphatic resin and naphthenic oil in a ratio of about 2:1, approximately equal parts of aliphatic and aromatic solvent, and approximately equal parts of two different thermoplastic synthetic polymers such as polystyrene and polybutylene.

According to one particularly preferred embodiment of the invention, a 0 translucent lubricant is provided that comprises about 40 weight percent aliphatic resin, about 20 weight percent naphthenic oil, about 15 weight percent mineral spirits, about 15 weight percent aromatic solvent, about 3 weight percent oxidized wax, about 2 weight percent sheep tallow, about 2 weight percent sulfur-phosphorous gear oil additive, about 1.5 weight percent calcium petronate, about 0.5 weight percent polystyrene, about 0.5 weight percent polybutene, and the remainder of a suitable antiwear agent such as molybdenum dithiocarbamate.

The subject lubricant is translucent, highly adhesive, and effective over a broad temperature range. While particularly preferred for use in coating wire ropes, cables and chains, the translucent lubricant disclosed herein is also useful for application to rollers, cams and slides, wheels, piano-type hinges, open gears, locks, dollies, manifold heat valves, and slide bearings.

DETAILED DESCRIPTION

The compositions of the invention are desirably made using an aliphatic or aromatic resin and an oil or synthetic fluid as the principal components. Particularly desirable results are achieved when the combined resin and oil components comprise from about 40 to about 80 weight percent of the lubricant and when the ratio of resin to oil is about 2 to 1. Preferred aliphatic and aromatic resins for use in the invention can include both natural and synthetic resins, including for example, beeswax, polyterpene resins, monomer resins, acrylic resins, and thermoplastic synthetic polymers such as polyethylene.

A particularly preferred aliphatic, tackifying resin is a low softening point, low molecular weight, aliphatic resin such as Piccopale 100® resin, made by Hercules, Incorporated. Piccopale 100® resin is a pale, neutral resin derived mainly from dienes and other reactive olefin monomers, and is characterized by its high resistance to moisture, UV stability, tack and tack retention, excellent binding qualities, and good compatability and solubility. Aromatic resins suitable for use in the invention can include, for example, Hercotac AD 4100 from Hercules or Petrolite WB-5 from Petrolite. Although the amount of aliphatic or aromatic resin can range from as low as about 2 weight percent up to about 75 weight percent of the translucent lubricant, the use of from about 10 to about 60 weight percent, and most preferably, from about 30 to about 50 weight percent, is preferred.

Preferred oils or synthetic fluids for use in the invention include hydrotreated naphthenic oils, hydrotreated heavy paraffinic oils, poly alpha olefins (especially hydrogenated decenes and trimers), diesters and polyol esters. A particularly preferred oil is 2000 SUS pale oil, a severely hydrotreated heavy naphthenic distillate. Although the amount of oil or synthetic fluid can range from as low as about 2 weight percent up to about 75 weight percent of the translucent lubricant, the use of from about 5 to about 40 weight percent, and most preferably, from about 15 to about 25 weight percent, is preferred.

Although compositions exhibiting the stated utility of the invention can be made wherein the amount of oil is greater than the amount of aliphatic or aromatic resin, the use of more resin than oil is generally preferred, and compositions having resin-to-oil ratios of about 2 to 1 are particularly preferred. Compositions made with significantly greater amounts of oil than aliphatic or aromatic resin may be very thin, and compositions made with significantly greater amounts of aliphatic or aromatic resin than oil may be too tacky and may solidify at temperatures that are generally above the preferred operational range of the lubricant.

For purposes of this invention, the degree of "tackiness" is determined by spraying the finished lubricant on a cable, allowing it to dry, and then pulling the lubricated cable through a box of sand. This testing technique simulates to some degree the exposure to sand and grit contamination that might be encountered by a wire rope used on a dragline in a strip mine. Although a little tack is desirable in the finished product, as represented for example by sand adhering to about 10 percent of the coated cable surface when subjected to the test, too much tack promotes increased wear and decreased service life for the product and for the coated cable.

The range of operating temperatures over which the translucent lubricants of the invention are intended to be flowable so as to achieve good penetration at the time of application, yet also adhere to the coated surface to provide the desired lubrication and protection, extends from a low temperature of about 20° F. or lower to a high temperature as great as would normally be encountered in functional field use.

Preferred solvents for use in the compositions of the invention include aliphatic solvents such as mineral spirits, ES-1 solvent made by Exxon, kerosene, Stoddard Solvent, heptane, hexane, VM&P naphtha, 140 Solvent 66 and aromatic solvents such as Aromatic 100 solvent made by Exxon, and toluene, xylene, heavy aromatic naphtha (H.A.N.) and SC (solvent class) #1, SC #2, SC #3, SC #150 and SC #28. The total amount of solvent used in making the translucent lubricant preferably ranges from about 10 to about 40 percent by weight. Although the use of both an aliphatic solvent and an aromatic solvent is not required for practicing the invention, preferred translucent lubricants are made by using both aliphatic and aromatic solvent components, and most preferably, by using from about 20 to about 30 weight percent total solvent with approximately equal amounts of each.

The translucent lubricants of the invention preferably further comprise a minor effective amount up to about 15 weight percent of thermoplastic synthetic polymer, a minor effective amount up to about 15 weight percent of an oxidized wax, a minor effective amount up to about 5 weight percent sheep tallow, and the remainder of performance additives comprising minor effective amounts of an extreme pressure additive, an antiwear additive and a corrosion inhibitor.

The thermoplastic synthetic polymer component is desirably an olefinic thermoplastic selected from the group including, for example, polystyrene, polybutene, polyethylene, polyisobutylene, methacrylates, olefin copolymers, and mixtures thereof. According to one preferred embodiment of the invention, the translucent lubricant comprises from about 0.1 to about 10 weight percent polybutene and from about 0.1 to about 5 weight percent polystyrene, and most preferably, approximately equivalent amounts of both polybutene and polystyrene that range from about 0.5 to about 1.5 weight percent each. A particularly preferred polybutene polymer for use in the invention is Paratac® polymer, made by Paramins (a division of Exxon) and a particularly preferred polystyrene polymer is Lubrizol 3140® polymer, made by Lubrizol Corp.

The oxidized wax component of the invention is believed to function as a film forming agent, and is preferably included in a minor effective amount, such as from about 0.1 to 1 weight percent, ranging up to a maximum of about 15 weight percent of the translucent lubricant. A preferred oxidized wax for use in the invention is marketed by Alox Corp. under the trademark Alox 2028.

The sheep tallow component of the invention is believed to function as a lubricant, water displacer and corrosion inhibitor, and is preferably included in a minor effective amount, such as from about 0.1 to 1 weight percent, ranging up to a maximum of about 25 weight percent of the translucent lubricant, with a range of from about 1 to about 5 weight percent being most preferred. Where amounts of sheep tallow above about 5 weight percent are used in making the compositions of the invention, the total amount of aliphatic or aromatic resin and oil can be reduced.

The extreme pressure agent component of the invention is preferably included in a minor effective amount, such as from about 0.1 to 1 weight percent, ranging up to a maximum of about 10 weight percent of the translucent lubricant, with a range of from about 1 to about 5 weight percent being most preferred. A preferred extreme pressure agent for use in the invention is a sulfur-phosphorous gear oil additive marketed by Elco Corp. under the trademark Elco 391, but this component can be replaced with a similarly effective amount of any of the following: sulfurized lard oil, sulfurized vegetable oil, sulfurized rapeseed (canola oil) oil, sulfurized sunflower oil, sulfurized soybean oil, zinc dithiocarbamate (alkyl and aryl), zinc dithiophosphate (alkyl and aryl), antimony dithiocarbamate, antimony dithiophosphate, lead dithiocarbamate, sulfurized whale oil substitute, sulfurized isobutylene, methylene bis-dibutyldithiocarbamate, aromatic amine phosphate, aliphatic amine phosphate, and phosphate esters.

The antiwear agent component of the invention is preferably included in a minor effective amount, such as from about 0.01 to 1 weight percent, ranging up to a maximum of about 3 weight percent of the translucent lubricant, with a range of from about 0.1 to about 1 weight percent being most preferred. A preferred antiwear agent for use in the invention is molybdenum dithiocarbamate, marketed by R. T. Vanderbilt under the trademark Molyvan L.

The corrosion inhibitor component of the invention is preferably included in a minor effective amount, such as from about 0.1 to 1 weight percent, ranging up to a maximum of about 10 weight percent of the translucent lubricant, with a range of from about 1.5 to about 5 weight percent being most preferred. A preferred corrosion inhibitor for use in the invention is calcium petronate, marketed for example by Witco Corp. under the trademark Petronate 25H, but it will be appreciated by those of skill in the art that this component can be replaced with a similarly effective amount of any of the following: calcium sulfonate, barium sulfonate, barium petronate, magnesium sulfonate, magnesium petronate, hexadecenyl succinic anhydride, octadecenyl succinic anhydride, and phosphate esters.

EXAMPLE

According to a particularly preferred embodiment of the invention, a translucent lubricant as described herein is prepared using 40.8 weight percent aliphatic resin (Piccopale 100), 18.7 weight percent naphthenic oil (2000 Pale Oil), 15.45 weight percent aliphatic solvent (mineral spirits), 15.45 weight percent aromatic solvent (Aromatic 100), 3 weight percent oxidized wax (Alox 2028), 2 weight percent sulphur-phosphorous gear oil additive (Elco 391), 2 weight percent processed sheep tallow, 1.5 weight percent calcium petronate (Petronate 25H), 0.5 weight percent polystyrene polymer (Lubrizol 3140), and 0.5 weight percent polybutene polymer (Paratac).

The polymeric resin is first dissolved in the lubricating oil at a temperature of approximately 160° to 220° F. The oxidized wax, sheep tallow, corrosion inhibitor, polystyrene polymer, and polybutene polymer are then added and mixed thoroughly. The composition is cooled to about 100° to 125° F., the extreme pressure agent, the antiwear agent, mineral spirits and aromatic solvent are added, and the lubricant is mixed for approximately 20 minutes.

The lubricant can be applied to the object or surface to be coated with a 1–2 gallon garden sprayer, aerosol spray can, brush, or with various other dip or drip methods. It should be applied liberally and allowed to dry. A second coating may be applied in high-contamination applications or where heavy loading may occur.

While several embodiments of the invention have been shown and described, other equivalents will be readily apparent to those of ordinary skill in the art upon reading this disclosure. Thus, the invention is not limited to these embodiments but, rather, is intended to cover all such variations as may be within the scope of the invention as defined by the following claims.

What is claimed is:

1. A translucent lubricant comprising a resin tackifying selected from the group consisting of aliphatic and aromatic resins and mixtures thereof, a fluid selected from the group consisting of oils and synthetic fluids, a solvent selected from the group consisting of aliphatic and aromatic solvents and mixtures thereof, a thermoplastic synthetic polymer, oxidized wax, sheep tallow, an extreme pressure agent, an antiwear agent, and a corrosion inhibitor.

2. The translucent lubricant of claim 1 wherein the aliphatic and aromatic resins are selected from the group consisting of beeswax, polyterpene resins, acrylic resins, thermoplastic synthetic polymers, and other monomer resins.

3. The translucent lubricant of claim 1 wherein the tackifying resin comprises from about 2 to about 75 weight percent of the lubricant.

4. The translucent lubricant of claim 3 wherein the tackifying resin comprises from about 10 to about 60 weight percent of the lubricant.

5. The translucent lubricant of claim 4 wherein the tackifying resin comprises from about 30 to about 50 weight percent of the lubricant.

6. The translucent lubricant of claim 1 wherein the fluid is selected from the group consisting of hydrotreated naphthenic oils, hydrotreated heavy paraffinic oils, poly alpha olefins, diesters and polyol esters.

7. The translucent lubricant of claim 6 wherein the fluid is a hydrotreated heavy naphthenic distillate.

8. The translucent lubricant of claim 1 wherein the fluid comprises from about 2 to about 75 weight percent of the lubricant.

9. The translucent lubricant of claim 8 wherein the fluid comprises from about 5 to about 40 weight percent of the lubricant.

10. The translucent lubricant of claim 9 wherein the fluid comprises from about 5 to about 40 weight percent of the lubricant.

11. The translucent lubricant of claim 1 comprising from about 40 to about 80 weight percent tackifying resin and fluid.

12. The translucent lubricant of claim 11 comprising from about 40 to about 80 weight percent tackifying resin and naphthenic oil.

13. The translucent lubricant of claim 12 comprising from about 40 to about 80 weight percent aliphatic resin and naphthenic oil.

14. The translucent lubricant of claim 1 wherein the ratio of tackifying resin to fluid is about 2:1 by weight.

15. The translucent lubricant of claim 1 wherein the solvent is selected from the group consisting of mineral spirits, kerosene, Stoddard Solvent, heptane, hexane, VM&P naphtha, 140 Sovlent 66 and mixtures thereof.

16. The translucent lubricant of claim 1 comprising from about 10 to about 40 weight percent solvent.

17. The translucent lubricant of claim 16 comprising from about 20 to about 30 weight percent solvent.

18. The translucent lubricant of claim 1 wherein the solvent comprises both an aliphatic and aromatic solvent.

19. The translucent lubricant of claim 18 wherein the aliphatic and aromatic solvents are present in a ratio of about 1:1 by weight.

20. The translucent lubricant of claim 1 wherein the thermoplastic synthetic polymer is an olefinic thermoplastic.

21. The translucent lubricant of claim 20 wherein the thermoplastic synthetic polymer is selected from the group consisting of polystyrene, polybutene, polyethylene, polyisobutylene, and mixtures thereof.

22. The translucent lubricant of claim 21 wherein the thermoplastic synthetic polymer comprises polybutene and polystyrene.

23. The translucent lubricant of claim 22 comprising substantially equal amounts by weight of polybutene and polystyrene.

24. The translucent lubricant of claim 1 comprising from about 0.1 to about 15 weight percent of thermoplastic synthetic polymer.

25. The translucent lubricant of claim 24 comprising from about 0.1 to about 10 weight percent polybutene.

26. The translucent lubricant of claim 25 comprising from about 0.5 to about 1.5 weight percent polybutene.

27. The translucent lubricant of claim 24 comprising from about 0.1 to about 5 weight percent polystyrene.

28. The translucent lubricant of claim 27 comprising from about 0.5 to about 1.5 weight percent polystyrene.

29. The translucent lubricant of claim 1 comprising from about 0.1 to about 15 weight percent oxidized wax.

30. The translucent lubricant of claim 29 comprising from about 1 to about 15 weight percent oxidized wax.

31. The translucent lubricant of claim 1 comprising from about 0.1 to about 25 weight percent sheep tallow.

32. The translucent lubricant of claim 1 comprising from about 1 to about 5 weight percent sheep tallow.

33. The translucent lubricant of claim 1 wherein the extreme pressure agent is selected from the group consisting of a sulfur-phosphorous gear oil additive, sulfurized lard oil, sulfurized vegetable oil, sulfurized rapeseed oil, sulfurized sunflower oil, sulfurized soybean oil, zinc dithiocarbamate, antimony dithiocarbamate, antimony dithiophosphate, lead dithiocarbamate, sulfurized whale oil substitute, sulfurized isobutylene, methylene bis-dibutyidithiocarbamate, aromatic amine phosphate, aliphatic amine phosphate, and phosphate esters.

34. The translucent lubricant of claim 33 wherein the extreme pressure agent is sulfur-phosphorous gear oil additive.

35. The translucent lubricant of claim 1 comprising from about 0.1 to about 10 weight percent extreme pressure agent.

36. The translucent lubricant of claim 35 comprising from about 1 to about 5 weight percent extreme pressure agent.

37. The translucent lubricant of claim 1 wherein the antiwear agent is molybdenum dithiocarbamate.

38. The translucent lubricant of claim 1 comprising from about 0.01 to about 3 weight percent antiwear agent.

39. The translucent lubricant of claim 38 comprising from about 0.1 to about 1 weight percent antiwear agent.

40. The translucent lubricant of claim 1 wherein the corrosion inhibitor is selected from the group consisting of calcium petronate, calcium sulfonate, barium sulfonate, barium petronate, magnesium sulfonate, magnesium petronate, hexadecenyl succinic anhydride, octadecenyl succinic anhydride, and phosphate esters.

41. The translucent lubricant of claim 1 comprising from about 0.1 to about 10 weight percent tackifying corrosion inhibitor.

42. The translucent lubricant of claim 41 comprising from about 1.5 to about 5 weight percent tackifying corrosion inhibitor.

43. A translucent lubricant comprising from about 40 to about 80 weight percent of a mixture of a resin and an oil, from about 10 to about 40 weight percent solvent, from about 1 to about 15 weight percent thermoplastic synthetic polymer, from about 1 to about 15 weight percent oxidized wax, from about 1 to about 15 percent sheep tallow, an extreme pressure agent, an antiweaer agent, and a corrosion inhibitor.

44. The translucent lubricant of claim 43 wherein the solvent comprises an aliphatic solvent and an aromatic solvent.

45. The translucent lubricant of claim 43 wherein the thermoplastic synthetic polymer comprises polybutene and polystyrene.

46. The translucent lubricant of claim 43 wherein the extreme pressure agent is sulfur-phosphorous gear oil additive.

47. The translucent lubricant of claim 43 wherein the antiwear agent is molybdenum dithiocarbamate.

48. The translucent lubricant of claim 43 wherein the corrosion inhibitor is calcium petronate.

49. A translucent lubricant comprising about 40 weight percent aliphatic resin, about 20 weight percent naphthenic oil, about 15 weight percent mineral spirits, about 15 weight percent aromatic solvent, about 3 weight percent oxidized wax, about 2 weight percent sheep tallow, about 2 weight percent sulfur-phosphorous gear oil additive, about 1.5 weight percent calcium petronate, about 0.5 weight percent polystyrene, about 0.5 weight percent polybutene, and the remainder of a suitable antiwear agent.

* * * * *

UNITED STATES PATENT AND TRADEMARK OFFICE

CERTIFICATE OF CORRECTION

PATENT NO : 5,877,131

DATED : March 2, 1999

INVENTOR(S) : John F. Barnes

It is certified that error appears in the above-identified patent and that said Letters Patent is hereby corrected as shown below:

Col. 5, line 28
replace "a resin tackifying"
with --a tackifying resin--.

Signed and Sealed this

Twenty-fourth Day of August, 1999

*Attest:*

Q. TODD DICKINSON

*Attesting Officer*

*Acting Commissioner of Patents and Trademarks*

UNITED STATES PATENT AND TRADEMARK OFFICE
CERTIFICATE OF CORRECTION

PATENT NO : 5,877,131

DATED : March 2, 1999

INVENTOR(S) : John F. Barnes

It is certified that error appears in the above-identified patent and that said Letters Patent is hereby corrected as shown below:

IN THE CLAIMS

Claim 33, column 6, line 60, change "bis-dibutyidithiocarbamate" to

–bis-dibutyldithiocarbamate—;

Claim 41, column 7, line 14, remove "tackifying" prior to –corrosion—;

Claim 42, column 7, line 17, remove "tackifying" prior to –corrosion—;

Claim 43, column 7, line 25, change "antiweaer" to –antiwear—.

Signed and Sealed this

Thirtieth Day of November, 1999

*Attest:*

*Attesting Officer*

Q. TODD DICKINSON

*Acting Commissioner of Patents and Trademarks*